US006390186B1

(12) United States Patent
Laudic et al.

(10) Patent No.: US 6,390,186 B1
(45) Date of Patent: May 21, 2002

(54) HEAT EXCHANGER WITH A BANK OF TUBES CONTAINED IN A CYLINDRICAL CASING

(75) Inventors: Hélène Laudic, Le Pecq; Jacques Hoffnung, L'Ile Saint Denis, both of (FR)

(73) Assignee: Valeo Thermique Moteur, LaVerriere (FR)

( * ) Notice: Subject to any disclaimer, the term of this patent is extended or adjusted under 35 U.S.C. 154(b) by 0 days.

(21) Appl. No.: 09/441,243

(22) Filed: Nov. 16, 1999

(30) Foreign Application Priority Data

Nov. 16, 1998 (FR) ..... 98 14347

(51) Int. Cl.[7] ..... F28F 9/02
(52) U.S. Cl. ..... 165/158; 165/DIG. 416
(58) Field of Search ..... 165/158, 159, 165/160, 162, DIG. 416; 123/568.12, 568.17

(56) References Cited

U.S. PATENT DOCUMENTS

| | | | | |
|---|---|---|---|---|
| 847,496 A | * | 3/1907 | Nelson | 165/158 |
| 3,223,154 A | | 12/1965 | Goebel | |
| 3,417,812 A | * | 12/1968 | Smith | 165/158 |
| 4,733,722 A | * | 3/1988 | Forbes et al. | 165/159 |
| 4,840,227 A | * | 6/1989 | Schmidt | 165/158 |
| 4,918,917 A | | 4/1990 | Woods | |
| 5,004,042 A | * | 4/1991 | McMorries, IV et al. | 165/159 |
| 5,004,047 A | | 4/1991 | Meier et al. | |
| 5,327,957 A | * | 7/1994 | Killebrew | 165/159 |
| 5,671,807 A | * | 9/1997 | Lameris | 165/158 |
| 5,915,472 A | * | 6/1999 | Takikawa et al. | 165/160 |

FOREIGN PATENT DOCUMENTS

| | | |
|---|---|---|
| DE | 41 41 556 | 12/1991 |
| DE | 297 08 011 | 8/1998 |
| EP | 0 718 583 | 6/1996 |
| FR | 2 648 549 | 12/1990 |
| GB | 20991 | of 1915 |

* cited by examiner

*Primary Examiner*—Henry Bennett
*Assistant Examiner*—Terrell McKinnon
(74) *Attorney, Agent, or Firm*—Morgan & Finnegan, LLP

(57) ABSTRACT

Heat exchanger for recovering heat from the exhaust gases of a motor vehicle, in which the exhaust gases circulate between two manifolds delimited by respective caps and by the end walls of a cylindrical casing, passing in tubes which are elongated in the axial direction in the casing. The caps are produced by stamping from a thin sheet metal, which leads to a reduction in weight and in cost and allows the caps to remain fitted snugly by elasticity on the ends of the casing, until brazed.

19 Claims, 1 Drawing Sheet

HEAT EXCHANGER WITH A BANK OF TUBES CONTAINED IN A CYLINDRICAL CASING

FIELD OF THE INVENTION

The present invention relates to the field of heat exchangers.

BACKGROUND OF THE INVENTION

It is known to provide heat exchangers for heat transfer between a first fluid and a second fluid, comprising:

- a central casing of generally axisymmetric cylindrical shape formed by two end walls and a cylindrical peripheral wall equipped with inlet and outlet piping for the first fluid;
- a bank of tubes which are elongated parallel to the axis of the casing, the end regions of each tube passing, in fluid-tight fashion, through apertures formed in said end walls, and the outer faces of the tubes delimiting, within the casing, a chamber for the circulation of the first fluid; and
- two axisymmetric annular caps respectively capping the two ends of the casing and connected in a leak tight way at their periphery, so as, with the end manifolds which communicate with each other by means of tubes for the circulation of the second fluid, to define the central apertures of the caps constituting respectively an inlet aperture and an outlet aperture for the second fluid.

Such exchangers are used particularly for recovering heat from the exhaust gases of motor vehicles, the first fluid being a fluid in circulation for recovering the heat, and the second fluid consisting of the exhaust gases.

In these known exchangers, the various elements are assembled together so as to be fluid-tight by brazing, and the end caps are solid molded components. The material used is stainless steel, in order to allow brazing. These pieces are re-worked at the machining stage in order to obtain a good fit between the assembly and the other components and to obtain the correct surface finish necessary for brazing. The material and the manufacturing technique make the pieces heavy and expensive.

Moreover, the caps have no elasticity and have to be fitted over the casing with clearance. They cannot be held on the casing by friction, and tack welds have to be formed in order to hold the pieces together until brazing.

Finally, the absence of elasticity of the caps severely limits the permitted oval shaping of the casing.

An object of the invention is to remedy the drawbacks set out above.

SUMMARY OF THE INVENTION

According to a first aspect the present invention provides a heat exchanger for heat transfer between a first fluid and a second fluid, comprising:

- a central casing of generally axisymmetric cylindrical shape formed by two end walls and a cylindrical peripheral wall equipped with inlet and outlet piping for the first fluid and by two end walls;
- a bank of tubes which are elongated parallel to the axis of the casing, the end regions of each tube passing, in fluid-tight fashion, through apertures formed in said end walls, and the outer faces of the tubes delimiting, within the casing, a chamber for the circulation of the first fluid; and

- two axisymmetric annular caps respectively capping the two ends of the casing and connected in a leak tight way to their periphery, so as, with the end walls of manifolds which communicate with each other by means of tubes for the circulation of the second fluid, to define central apertures of the caps constituting respectively an inlet aperture and an outlet aperture for the second fluid, wherein the caps are made from stamped sheet metal.

The stamped sheet metal caps are lighter and less expensive than the molded and machined caps of the state of the art. Their elasticity facilitates assembling the caps the casing and holding them in the assembled state before brazing.

These effects are further reinforced by a slight oval shaping, obtained naturally by the stamping from thin rolled sheet metal. The oval shape and sheet metal material make it possible simultaneously to obtain an appropriate diametrical clearance between the casing and the cap, and light clamping in a particular radial direction, allowing the assembly to be held together.

Optional supplementary or alternative characteristics of the invention are set out below:

- at least one of the caps include, at its axial end turned away from the casing, a radially internal cylindrical portion defining axial inlet or outlet piping for the second fluid.
- the outer face of the axial piping is brazed to the inside of a through hole formed in a plate-type fixing flange which extends perpendicularly to the axis of the casing.
- the cap includes, close to the axial piping, a portion oriented substantially radially which is brazed onto the face of the flange turned towards the casing.
- at least one of the caps includes a snug-fitting cylindrical portion covering an end region of said peripheral wall.
- said snug-fitting cylindrical portion is adjacent to a flared portion situated at the axial end of the cap turned towards the casing, able to facilitate the fitting of the cap snugly on the casing.
- said snug-fitting cylindrical portion is connected, going away from the casing, to a portion of progressively decreasing diameter forming an abutment for the end of the casing and defining a path of variable cross-section for the second fluid between the casing and the inlet or outlet aperture.

According to another aspect, the invention provides a method of assembling a heat exchanger comprising the steps of:

- assembling a central casing of generally axisymmetric cylindrical shape formed by two end walls and a cylindrical peripheral wall equipped with inlet and outlet piping for the first fluid;
- assembling a bank of tubes which are elongated parallel to the axis of the casing, the end regions of each tube passing, in fluid-tight fashion, through apertures formed in said end walls, and the outer faces of the tubes delimiting, within the casing, a chamber for the circulation of the first fluid; and
- assembling two axisymmetric annular caps respectively capping the two ends of the casing and connected in a leak tight way to their periphery, so as, with the end walls of manifolds which communicate with each other by means of tubes for the circulation of the second fluid, to define central apertures of the caps constituting respectively an inlet aperture and an outlet aperture for the second fluid, wherein the caps are made from stamped sheet metal and wherein at least one of the caps exhibits a cylindrical snug-fitting portion covering an end region of said peripheral wall in which method: after having assembled the casing and the tubes, the caps are fitted snugly over the end regions of the casing, and the assembly thus obtained is brazed. The external diameter of the casing, the internal diameter of the snug-fitting cylindrical portion and the elasticity of the caps is such that the caps fit snugly with friction holding them in place before the brazing.

The method according to the invention may include at least some of the following features:

the casing and/or the caps exhibit a slightly oval shape and have an external diameter and an internal diameter respectively; the external diameter having a minimum value less than the minimum value of the internal diameter and having a maximum value greater than the maximum value of the internal diameter and the internal diameter of said snug-fitting portion being greater than the external diameter of the casing.

the snug-fitting movement of the caps is continued until their portion of progressively decreasing diameter comes into abutment on the end of the casing.

BRIEF DESCRIPTION OF THE DRAWINGS

The characteristics and advantages of the invention will be set out in greater detail in the description below, by referring to the attached drawings.

DESCRIPTION OF THE PREFERRED EMBODIMENT

Figure 1:
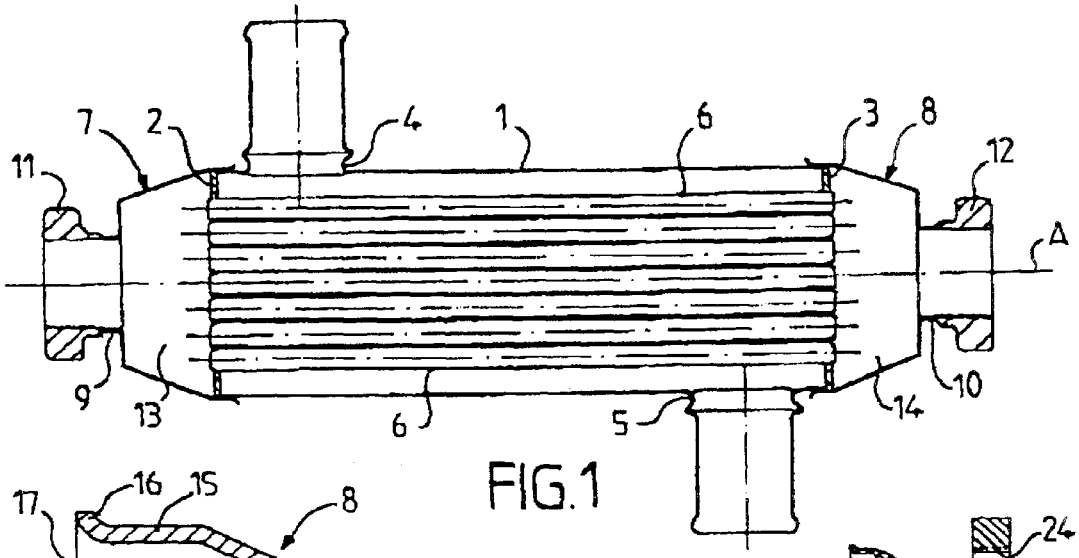
FIG. 1 is a view in axial section of a heat exchanger according to the invention for recovering heat from the exhaust gases of a motor vehicle.

In the various figures, like reference numerals refer to like parts.

The heat exchanger represented in FIG. 1 comprises, as is known, a central casing of axisymmetric cylindrical shape consisting of a cylindrical peripheral wall 1 and two circular end walls 2, 3. Inlet and outlet piping 4, 5 for the fluid for cooling the engine of the vehicle are formed on the wall 1, at diametrically opposed positions, one near the wall 2 and the other near the wall 3. Circular holes distributed over the surface of the walls 2 and 3 receive the ends of tubes 6 which are elongated parallel to the axis A of the casing. Two annular caps 7, 8 axisymmetric about the axis A, respectively cap the ends of the casing and are terminated, on the side away from the casing, by axial piping 9, 10 brazed respectively to flanges 11, 12 intended for fixing the heat exchanger onto the vehicle. The walls 1–3, the tubes 6, the caps 7, 8 and the flanges 11, 12 are assembled together by brazing so as to be leak tight to the fluids. The exhaust gases enter via the piping 9 into the manifold 13 delimited by the wall 2 and the cap 7, travel within the tubes 6 so as to reach the manifold 14 delimited by the wall 3 and the cap 8, and exit through the piping 10. The cooling fluid enters through the piping 4 into the casing 1–3, where it sweeps over the outer surface of the tubes so as to pick up the heat from the gases which are circulating within them, then exits through the piping 5. The circulation of the fluid and the gas may also take place in the opposite direction to what has just been described.

According to the invention, the caps 7, 8 are produced by stamping from thin rolled sheet metal. In addition to the reduction in weight and cost, this manufacturing technique allows the caps to be held in place temporarily on the ends of the casing by elasticity until they are brazed as described in detail below.

Figure 2:
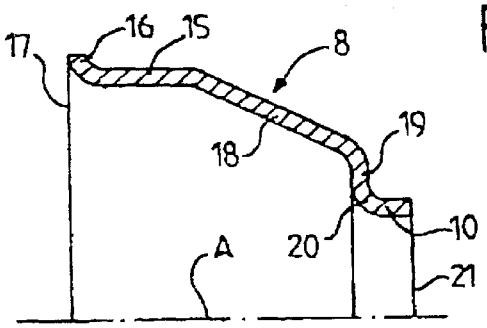
FIG. 2 is a half-view in axial section of a stamped sheet metal cap belonging to this exchanger.

It is seen in FIG. 2 that the cap 8, which is identical to the cap 7, comprises a cylindrical portion 15 which tightly surrounds the end region of the cylindrical wall 1 of the casing. The cylindrical portion 15 is adjacent to a flared portion 16, with a circular-arc cross-section, which extends as far as the axial end 17 of the cap which is turned towards the casing. Going away from the flared portion 16, the portion 15 is connected to a frustoconical portion 18 the diameter of which decreases in proportion to the distance from the casing. The frustoconical portion 18 is connected in turn, by a rounded feature, to a portion 19 extending substantially in a radial plane. Finally, the portion 19 is connected by a rounded feature 20 to the piping 10, which constitutes the smallest-diameter part of the cap and which extends as far as the axial end of the cap opposite the casing, where it defines a gas inlet or outlet aperture 21.

Figure 3:
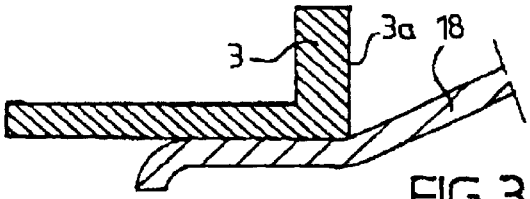
FIG. 3 is an enlarged detail of FIG. 1.

The flared portion 16 facilitates the insertion of the end of the casing into the cap, this insertion being continued until the outer face 3a of the end wall 3 of the casing comes into abutment on the frustoconical portion 18 of the cap, as shown in detail in FIG. 3. The frustoconical portion 18 also serves for guiding the gas between the inlet or outlet piping 10 and the ends of the tubes 6, which lie within a surface area substantially greater than the working cross-section of this piping.

Figure 4:
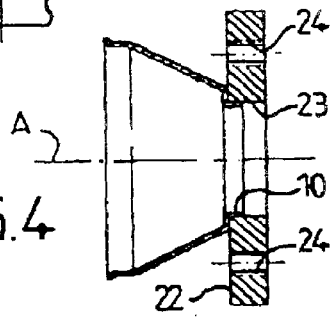
FIG. 4 is a view in axial section of the cap and of a fixing flange brazed to it.
Figure 5:
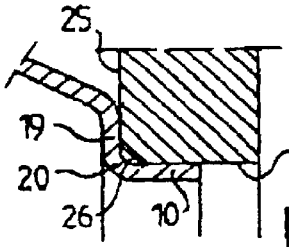
FIG. 5 is an enlarged detail of FIG. 4.

FIGS. 4 and 5 show the link between the cap 8 and a fixing flange 22 which is different from the flanges 11 and 12 which are represented in FIG. 1. The flange 22 has the shape of a plate extending parallel to a radial plane, traversed by a central cylindrical aperture 23 in which the piping 10 is housed and by two threaded holes 24, symmetric with one another with respect to the axis A. The threaded holes serve for fixing the heat exchanger onto a support which is not represented. As can be seen more particularly in FIG. 5, the flange 22 is in contact with the outer face of the radial portion 19 of the cap via the flange face 25 turned towards the casing, and with the outer face of the piping 10 via the wall of the aperture 23. It is brazed to these two surfaces, which ensures excellent mechanical stability of the assembly, particularly with regard to the vibration from the engine of the vehicle. An annular chamber 26 is formed facing the rounded feature 20.

Figure 6:
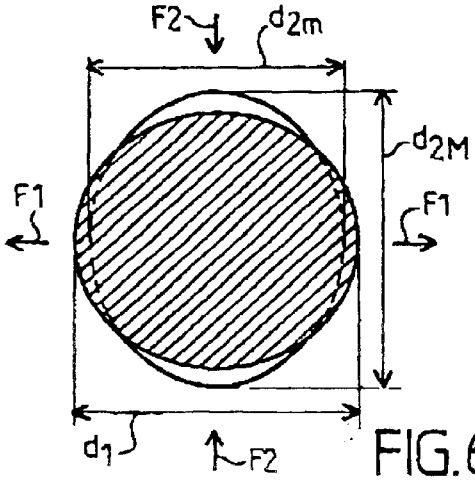
FIGS. 6 and 7 are explanatory diagrams relating to the snug fitting of a cap on the casing of the heat exchanger.

The technique of manufacturing the caps by stamping from thin sheet metal entails forming a slight oval shaping, which facilitates the assembling of the exchanger according to the invention, as will be explained by referring to FIG. 6. In the figure, the hatched circle diagrammatically represents the axisymmetric cylindrical casing 1, 2, of diameter $d_1$, and the non-hatched ellipse represents the internal perimeter of the snug-fitting cylindrical portion 15 of a cap, of minimum diameter $d_{2m}$ and of maximum diameter $d_{2M}$, the differences in diameter being represented with exaggeration for greater clarity. The value of $d_1$ lies between those of $d_{2m}$ and $d_{2M}$, such that, during the fitting, the minimum diameter of the cap increases, as indicated by the arrows F1, while its maximum diameter decreases, as indicated by the arrows F2. When fitting is complete, the casing bears radially on the cap, at two diametrically opposed places, according to the arrows F1, thus holding the cap by friction, while a clearance remains between the two components in the direction of the arrows F2, because the internal perimeter of the cylindrical portion 15 is greater than the external perimeter of the casing.

Although a practically axisymmetric casing and of an oval-shaped cap are the most frequent embodiments, the invention functions equally well when the casing is oval in shape, whether the cap is itself oval or axisymmetric, given the double condition that the maximum diameter of each of the two interacting cylindrical surfaces is greater than the minimum diameter of the other, and that the internal perimeter of the cylindrical portion 15 is greater than the external perimeter of the casing.

Figure 7:
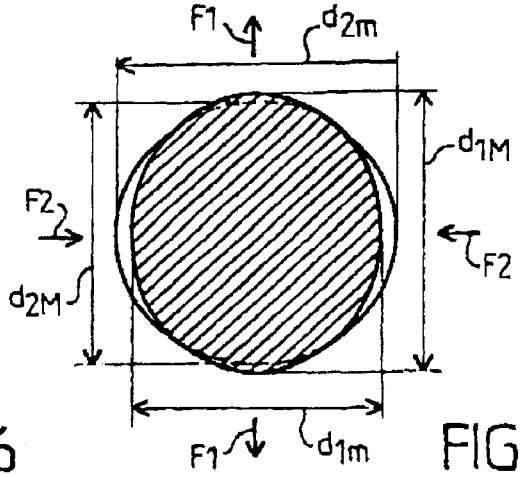

FIG. 7 illustrates the case where these two elements are oval in shape, the casing more so than the cap. The relationship $d_{1m}<d_{2m}<d_{2M}<d_{1M}$ exists, the letters m and M indicating respectively a minimum diameter and a maximum diameter, and the numbers 1 and 2 being allocated respectively to the external diameter of the casing and to the internal diameter of the snug-fitting portion cylindrical 15 of the cap. The arrows F1 marking the expansion of the cap are then oriented in the direction of the maximum diameters, and the arrows F2 indicating the contraction of the cap, in the direction of minimum diameters, in contrast to the case of FIG. 6.

What is claimed is:

1. A heat exchanger for heat transfer between a first fluid and a second fluid, the heat exchanger comprising:

a casing of generally axisymmetric cylindrical shape formed by two end walls and a cylindrical peripheral wall equipped with inlet piping and outlet piping for the first fluid;

a bank of tubes elongated parallel to the axis of the casing, end regions of each tube passing, in fluid-tight fashion, through apertures formed in said end walls, and outer faces of the bank of tubes delimiting, within the casing, a chamber for circulation of the first fluid; and two axisymmetric annular caps, each respectively capping ones of said end walls of the casing and connected in a leak tight way to the periphery of said end wall, so as to define manifolds which communicate with each other via the bank of tubes for circulation of the second fluid, central apertures in the caps constituting respectively an inlet aperture and an outlet aperture for the second fluid, wherein the caps are made from stamped sheet metal, and wherein the casing and the caps have a slightly oval shape, the casing have an external diameter and the caps having an internal diameter; the external diameter of the casing having a minimum value less than the minimum value of the internal diameter and having a maximum value greater than the maximum value of the internal diameter.

2. A heat exchanger for heat transfer between a first fluid and a second fluid, the heat exchanger comprising:

a generally cylindrical casing formed by two end walls and a cylindrical peripheral wall equipped with piping for said first fluid, said end walls having apertures;

a bank of tubes elongate parallel to the cylindrical axis of said casing, end regions of each tube passing in fluid-tight fashion through said apertures in said end walls, outer faces of said tubes delimiting a chamber within said casing for circulation of said first fluid; and two axisymmetric annular caps, each of said caps connected in a leak tight way to the periphery of ones of said end walls to define a manifold, the first of said caps defining a first manifold, the second of said caps defining second manifold, said first manifold communicating via said bank of tube with said second manifold for circulation of said second fluid, central apertures in each of said caps constituting apertures for said second fluid, wherein said caps are made from stamped sheet metal.

3. The heat exchanger of claim 2 wherein at least one of said caps includes a radially internal cylindrical portion at an axial end away from said casing, said radially internal cylindrical portion defining axial piping for said second fluid.

4. The heat exchanger of claim 3 further including a fixing flange with a through hole, the outer face of said axial piping connected to the interior of said through hole, said fixing flange extending perpendicular to the axis of said casing.

5. The heat exchanger of claim 4 wherein at least one of said caps further includes a radial portion substantially perpendicular to and adjacent to said axial piping, said radial portion connected to the face of said fixing flange facing said casing.

6. The heat exchanger of claim 2 wherein at least one of said caps further includes a cylindrical portion that covers and snugly fits over a portion of said cylindrical peripheral wall proximate ones of said end walls.

7. The heat exchanger of claim 6 wherein at least one of said caps further includes a flared portion situated at the axial end of said cap closest said casing and adjacent said cylindrical portion, said flared portion facilitating the fitting of said cap snugly on said casing.

8. The heat exchanger of claim 6 wherein said cylindrical portion is connected, going away from said casing, to a portion of progressively decreasing diameter forming an abutment for ones of said end walls of said casing and defining a path of variable cross-section for said second fluid between said casing and said apertures.

9. A heat exchanger for heat transfer between a first fluid and a second fluid, the heat exchanger comprising:

a casing of generally axisymmetric cylindrical shape formed by two end walls and a cylindrical peripheral wall equipped with inlet piping and outlet piping for the first fluid;

a bank of tubes elongated parallel to the axis of the casing, end regions of each tube passing, in fluid-tight fashion, through apertures formed in said end walls, and outer faces of the bank of tubes delimiting, within the casing, a chamber for circulation of the first fluid; and two axisymmetric annular caps, each respectively capping ones of said end walls of the casing and connected in a leak right way to the periphery of said end wall, so as to define manifolds which communicate with each other via the bank of tubes for circulation of the second fluid, central apertures in the caps constituting respectively an inlet aperture and an outlet aperture for the second fluid, wherein the caps are made from stamped sheet metal.

10. The heat exchanger of claim 9, wherein at least one of the caps includes, at an axial end away from the casing, a radially internal cylindrical portion defining axial inlet piping or axial outlet piping for the second fluid.

11. The heat exchanger of claim 10, further including a plate-type fixing flange, wherein the outer face of the axial inlet piping or axial outlet piping is brazed to the inside of a through hole formed in the plate-type fixing flange, the plate-type fixing flange extending perpendicularly to the axis of the casing.

12. The heat exchanger of claim 11, wherein at least one of the caps includes, close the axial inlet piping or axial outer piping, a portion oriented substantially radially which is brazed onto the face of the flange turned towards the casing.

13. The heat exchanger of claim 9, wherein at least one of the caps includes a cylindrical snug-fitting portion covering an end region of said cylindrical peripheral wall proximate ones of said end walls.

14. The heat exchanger of claim 13, wherein at least one of the caps further includes a flared portion situated at the axial end of the cap towards the casing and adjacent said snug fitting cylindrical portion, said flared portion facilitating the fitting of the cap snugly on the casing.

15. The heat exchanger of claim 13, wherein said snug-fitting cylindrical portion is connected, going away from the casing, to a portion of progressively decreasing diameter forming an abutment for ones of said end walls of the casing and defining a path of variable cross-section for the second fluid between the casing and the inlet aperture or the outlet aperture.

16. A vehicle comprising the device for heating and/or air conditioning of claim 9.

17. An axisymmetric annular cap comprising a cylindrical portion;

a flared portion adjacent said cylindrical portion in a first direction and situated at a first axial end of said cap;

a frustoconical portion adjacent said cylindrical portion in a second direction, said frustoconical portion progressively decreasing in diameter and defining a path of variable cross-section;

a second cylindrical portion extending radially in said second direction from said frustoconical portion to a second axial end of said cap, said cap stamped from sheet metal.

18. The axisymmetric annular cap of claim 17, further including a fixing flange extending perpendicular to the axis of the cylindrical portion, wherein the fixing flange has a through hole, and wherein the outer face of the second cylindrical portion is brazed to the inside of a through hole formed in the fixing flange.

19. The axisymmetric annular cap of claim 17, further including a portion oriented substantially radially from the outer face of the second cylindrical portion, the portion brazed to a face of the fixing flange.

* * * * *